United States Patent [19]

Verhulst

[11] Patent Number: 4,815,734

[45] Date of Patent: Mar. 28, 1989

[54] BASKETBALL HOOP MOUNTING STRUCTURE

[76] Inventor: Christopher P. Verhulst, 224 14th St., Seal Beach, Calif. 90740

[21] Appl. No.: 124,056

[22] Filed: Nov. 23, 1987

[51] Int. Cl.[4] ..... A63B 63/08

[52] U.S. Cl. ..... 273/1.5 R; 248/297.2

[58] Field of Search ..... 273/1.5 R, 1.5 A; 248/223.4, 224.1, 224.2, 225.1, 244, 245, 295.1, 297.2, 243, 246

[56] References Cited

U.S. PATENT DOCUMENTS

| | | | |
|---|---|---|---|
| 191,058 | 5/1877 | Johnson | 248/245 |
| 793,052 | 6/1905 | Chickering | 248/245 |
| 982,279 | 1/1911 | Knape | 248/244 |
| 1,055,201 | 3/1913 | Mason | 248/244 |
| 2,590,195 | 3/1952 | Merkle et al. | 248/245 |
| 3,078,484 | 2/1963 | Briggs | 15/21 |
| 3,529,798 | 9/1970 | Williams et al. | 248/469 |
| 3,814,359 | 6/1974 | Powell | 273/1.5 A |
| 3,915,189 | 10/1975 | Holbrook et al. | 248/224 X |
| 3,927,315 | 12/1975 | Werry | 248/223 X |
| 4,183,522 | 1/1980 | Killen | 273/1.5 R |
| 4,218,058 | 8/1980 | Hilbert et al. | 273/1.5 R |
| 4,271,751 | 6/1981 | Timmons | 248/223.4 X |
| 4,389,133 | 6/1983 | Oberst | 403/230 |
| 4,613,135 | 9/1986 | Rush | 273/1.5 R |

FOREIGN PATENT DOCUMENTS

| | | | |
|---|---|---|---|
| 631300 | 9/1927 | France | 248/245 |

*Primary Examiner*—Paul E. Shapiro

*Attorney, Agent, or Firm*—Fulwider, Patton, Rieber, Lee & Utecht

[57] ABSTRACT

A basketball mounting hoop including a vertical slot for receiving a hoop mount. The hoop mount includes a fastener slidably received in such slot and operable to clamp the mount to the back board slot at a selected height.

15 Claims, 1 Drawing Sheet

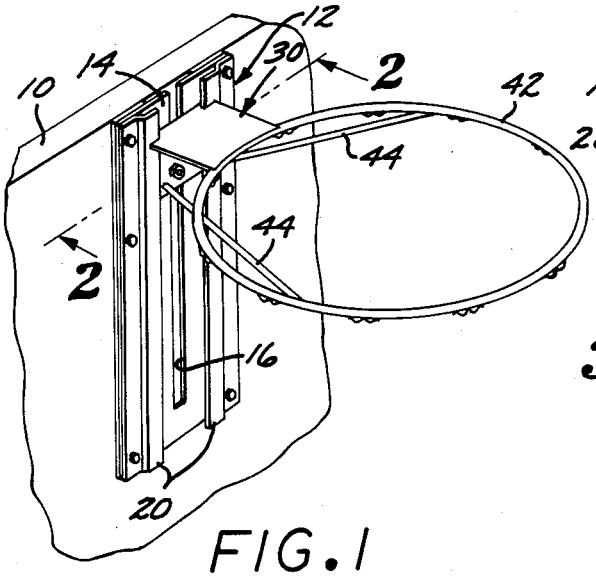
FIG. 1
FIG. 2
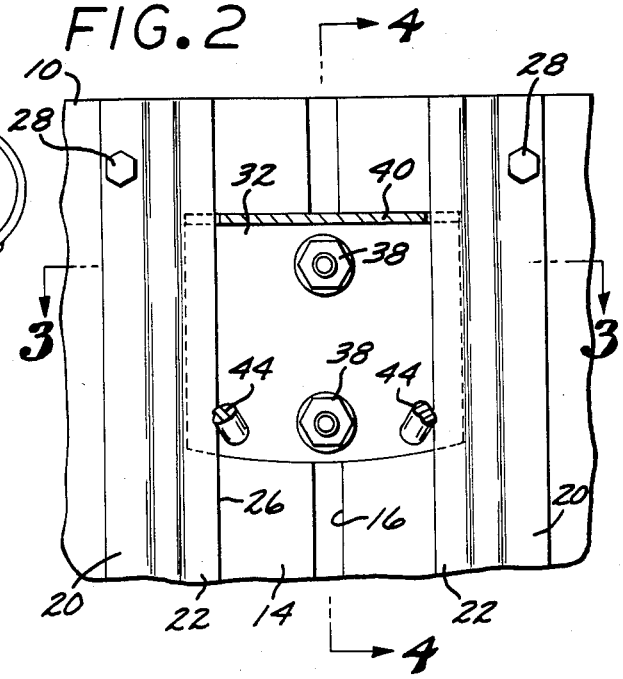
FIG. 3
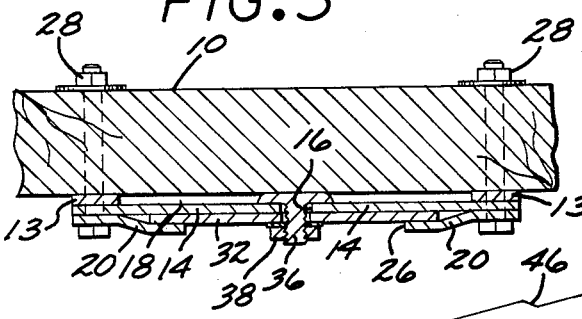
FIG. 4
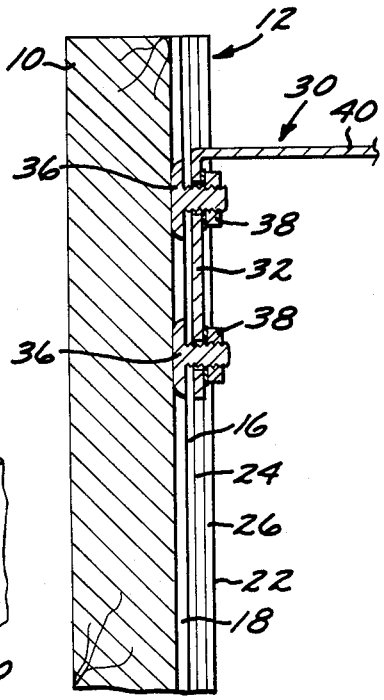
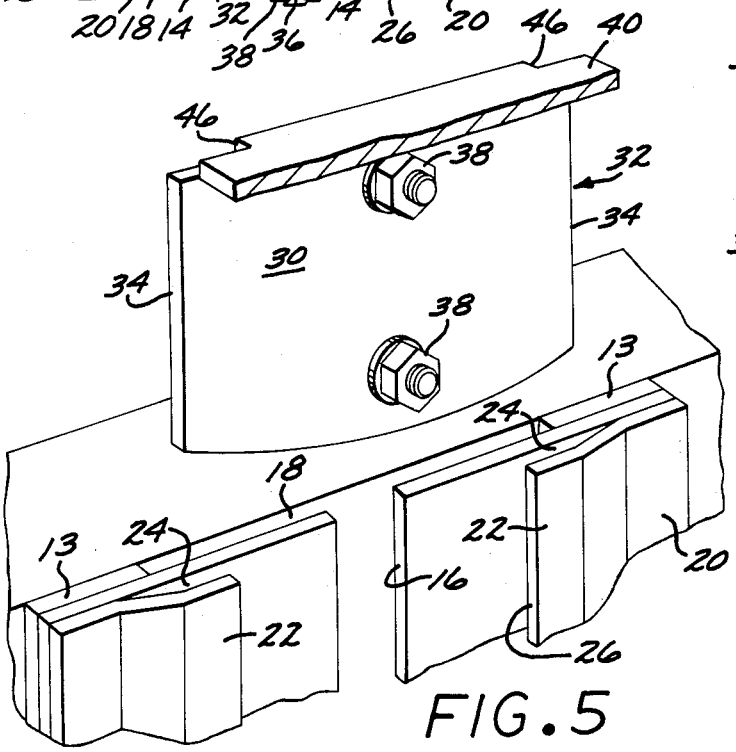
FIG. 5

BASKETBALL HOOP MOUNTING STRUCTURE

BACKGROUND OF THE INVENTION

1. Field of the Invention

The present invention relates to a structure for mounting a basketball hoop and more particularly to a structure which enables readily detachably mounting a basketball hoop at various selected heights.

2. Description of Related Art

Youngsters typically employ a single basket or hoop mounted on the outside surface of an overhead garage door for a quick neighborhood game of basketball. Since the age of the players varies the hoop should be adjustable in height. It should also be readily removable when the game is over so that the garage door can be raised and lowered for normal use.

Various structures have been patented to provide a system for removably mounting a basketball hoop to fixed structure. U.S. Pat. No. 4,613,135, issued to R. R. Rush, discloses one such device. A receptacle is attached to a basketball backboard and includes laterally spaced apart, vertically oriented channels. A hoop mounting member is slidable within the channels until a bolt on the receptacle engages the end of a slot in the mounting member. A wing nut on the bolt can be operated to clamp the mounting member onto the receptacle. In normal use the hoop mounting member rests upon the top of the receptacle, apparently to provide structural integrity or rigidity and the wing nut and bolt serve as a stop means to establish this position. The hoop mounting member is apparently not designed to be adjustable in height since raising it above its position of rest upon the receptacle exposes its vertical section to bending in order to bear ball impact loads on the hoop. Such exposure to bending is exaggerated the farther the hoop is raised.

U.S. Pat. No. 4,218,058, issued to Hilbert et al., teaches an analogous receptacle, with the slide channels being defined by oppositely disposed, vertically spaced apart pairs of channel sections, making the channels discontinuous. The hoop mounting bracket has to be moved inwardly and downwardly onto a selected pair of channel sections to establish the bracket at a desired height. This combination of movements requires precise bracket positioning, and the bracket would appear to be subject to inadvertent dismounting by sharp upward ball impacts upon the hoop.

U.S. Pat. No. 4,183,522, issued to Killen, is yet another form of hoop mounting structure. A pair of laterally spaced apart vertical standards having a series of vertically spaced slots are attached to a wall or the like. Inwardly and downwardly projecting tongues of four brackets are insertable into selected sets of the slots to secure a large backboard structure to the wall. The hoop mount is fixed to the backboard structure so that a major effort is involved in repositioning the backboard structure to adjust the height of the hoop.

SUMMARY OF THE INVENTION

According to the present invention, a basketball hoop mounting structure is provided which comprises a backboard mount easily secureable to fixed structure such as a wall or a garage door. The backboard mount includes a vertical slot and spacing members which define a fastener space between the backboard and the door in the area adjacent the vertical slot. A right angular hoop mount carrying the basketball hoop includes a vertical leg whose side edge margins are slidable within track channels defined by track legs of the backboard mount. The height of the vertical leg is fixed by one or more fastener means, each of which includes a head slidable in the fastener space, a threaded stud which extends through the slot, and a nut which is threaded onto the stud to bear against the vertical leg. The hoop mount also includes a horizontal leg attached to the hoop to support it. It is a feature of the invention that the horizontal leg includes cut out portions or openings in its side margins adjacent its juncture with the hoop mount vertical leg. These openings vertically slidably receive the track legs and, regardless of the adjusted height of the hoop mount, facilitate transfer of hoop impact loads between the hoop and backboard mounts. The hoop mount can be easily raised or lowered to adjust its vertical position, and the interconnection of the hoop and backboard mounts in all positions is stable and structurally rigid.

The hoop mount is readily separable from the backboard mount by loosening the fastener means and upwardly sliding the hoop mount until it disengages the backboard mount. The hoop mount can then be separately stored. The backboard mount remaining on the garage door is relatively inconspicuous and does not interfere with normal door operation.

Other aspects and advantages of the present invention will become apparent from the following more detailed description taken in conjunction with the accompanying drawings.

BRIEF DESCRIPTION OF THE DRAWINGS

FIG. 1 is a perspective view of a basketball hoop mounting structure according to the present invention, illustrated as it would appear when mounted to an overhead garage door;

FIG. 2 is an enlarged view taken along the line 2—2 of FIG. 1;

FIG. 3 is a view taken along the line 3—3 of FIG. 2;

FIG. 4 is a view taken along the line 4—4 of FIG. 2; and

FIG. 5 is an enlarged partial perspective view of the structure of FIG. 1 as the same would appear following separation or disengagement of the hoop mount from the backboard mount.

DETAILED DESCRIPTION OF THE PREFERRED EMBODIMENT

Referring now to the drawings, the present basketball hoop mounting structure is illustrated in association with a backboard and particularly an overhead garage door 10 in its vertical or lowered position. A garage door is merely exemplary of one form of basketball backboard. Obviously other types of backboard could also be used.

The hoop mounting structure comprises a backboard mount 12 which includes a rectangular, vertically elongated flat plate or back member 14 having an upwardly opening vertical slot 16 terminating above the bottom edge margin of the back member. The mount also includes a pair of relatively narrow, vertically extending, and laterally spaced apart spacer members 13 disposed between the mount 12 and the backboard 10 adjacent the side edge margins of the back member 14. The purpose of the spacer members is to define a fastener space 18 located behind the back member 14 adjacent the vertical slot 16. As will be seen, the space 18 provides room for fasteners associated with the hoop mounting structure to move vertically for adjustment of the height of the basketball hoop.

The backboard mount further includes a pair of oppositely located, vertically oriented channel or front members 20 which overlie the back member. The members 20 are characterized by inwardly directed, outwardly offset track legs 22 which define vertically elongated, confronting recesses or track channels 24. These are laterally spaced apart to define a vertical track opening 26 between their inner edge margins, as best seen in FIG. 5.

The vertical outer edge portions of the spacer members 17 and front members 20 are vertically aligned and secured together and to the backboard by a plurality of suitable nut and bolt fastener assemblies. Each assembly includes a headed bolt having a shank which extends through the members and through the backboard, a head which engages the associated front member 20, and a nut and washer engaged upon the rear surface of the backboard, as seen in FIG. 3.

Other backboard mount structure can be provided to define the desired track channels, such as oppositely disposed or confronting C-shape channel members (not shown), but the built up assembly described has been found to operate satisfactorily and it is easily fabicated and assembled.

The hoop mounting structure also includes an L shaped or right angular hoop mount 30 having a rectangular, vertically oriented leg 32 whose side edge margins 34 are slidably receivable within the track channels 24. The leg 32 includes vertically aligned openings that receive the threaded shanks of a pair of carriage bolts which project through the vertical slot 16. The heads 36 of the bolts are vertically slidable in the fastener space 18 during adjustment of the vertical height of the hoop mount. Fixing of the leg 20 in any vertically adjusted position is achieved by tightening nuts 38 onto the carriage bolts. With this arrangement an infinite number of vertical positions may be established along the length of the track opening 26 simply by loosening and retightening the nuts 38.

The hoop mount 30 also includes a horizontal leg 40 integral with and forming a horizontal continuation of the vertical leg 32. The legs 32 and 40 are preferably the same width for reasons which will become apparent.

A usual basketball hoop 42 is welded or otherwise secured to an arcuate outer or free edge of the horizontal leg 40. A pair of diagonally oriented support rods 44 are welded at their outer extremities to opposite sides of the hoop 42. At their inner extremities the rods are welded to the lower portion of the vertical leg 32, as seen in FIGS. 1 and 2. The support rods undergo compression to transfer ball impact loads on the top of the hoop 42 to the vertical leg 32. Conversely, the rods are placed in tension to transfer ball impact loads on the bottom of the hoop.

The orientation and configuration of the horizontal leg 40 assists in efficiently transferring hoop loads to the backboard mount to provide structural rigidity and stability to the assembly. As seen in FIG. 5, the horizontal leg 40 at its juncture with the vertical leg is cut away to provide openings 46 in its side margins. These openings vertically slidably receive the inwardly directed edge margins of the track legs 22.

The depth of each side margin opening 46 closely approximates the thickness of the associated track leg 22, and the thickness of the vertical leg 32 closely approximates the depth of the associated track channel 24. This minimizes relative movement between the hoop and backboard mount and enhances structural transfer of loads developing as a result of ball impacts upon the hoop 42. Downward ball impact loads on the hoop are transferred by the hoop mount to the rear surfaces of the track legs 22, and upward ball impact loads are transferred to the front faces of the track legs.

In operation, the lowered garage door 10 locates the backboard mount 12 in a vertical position. The vertical leg 32 of the hoop mount 30 can then be downwardly inserted into the top of the track opening 26 and lowered to the desired height. In cannot be lowered beyond the terminus of the slot 16. The nuts 38 are next tightened to secure the mounts 12 and 30 in fixed relationship.

Removal of the hoop mount for storage is simply a matter of loosening the nuts 38 to permit upward slidable movement and separation of the hoop mount from the backboard mount. During such slidable movement there is ample room in the fastener space 18 to permit the heads 36 to pass along the length of the vertical slot 16.

The present hoop mounting structure thus provides a convenient means for adjusting the height of a basketball hoop to suit the needs of players of different heights, the hoop mount is quickly releasable and separable from the backboard mount for storage, and the interengagement of the hoop and backboard mounts is such that ball impact loads upon the hoop are efficiently transferred to the backboard mount to provide stability and structural integrity.

Various modifications and changes be made with regard to the foregoing detailed description without departing from the scope and spirit of the invention.

I claim:

1. Basketball hoop mounting structure comprising:

a backboard mount including a vertical fastener oppositely located portions having vertical track legs define confronting track channels laterally spaced to form a vertical track opening; and a right angular hoop mount carrying a basketball and including a vertical leg having side edge margins within the track channels, and a horizontal leg openings formed in its side margins which slidably the tracks legs, the hoop mount further including means carried by the hoop mount vertical leg, slidably through the fastener slot, and operable to the hoop mount to the backboard mount at a selected along the track opening.

2. Basketball hoop mounting structure according to claim 1 wherein the backboard mount includes spacer means defining a fastener space providing clearance for slidable travel of the fastener means along the fastener slot.

3. Basketball hoop mounting structure according to claim 2 wherein the fastener means comprises a headed bolt and nut, the head of the bolt being located in the fastener space, and the nut bearing against the outer face of the hoop mount vertical leg.

4. Basketball hoop mounting structure according to claim 1 wherein the backbaord mount includes a back member having the fastener slot, and wherein the oppositely located portions of the background mount comprise a pair of vertically elongated front members which overlie the back member and include the vertical track legs.

5. Basketball hoop mounting structure according to claim 4 and including spacer means comprising a pair of vertically elongated spacer members engaged upon the back of the back member and defining therebetween a fastener space providing clearance for travel of the fastener means along the fastener slot.

6. Basketball hoop mounting structure according to claim 5 wherein the front members, back member and spacer members are adapted to receive and be secured together by the fastening means for attaching the backboard mount to a backboard.

7. Basketball hoop mounting structure according to claim 1 wherein the depth of each side margin opening in the hoop mount horizontal leg closely approximates the thickness of the associated track leg, and wherein the thickness of the hoop mount vertical leg closely approximates the depth of the track channels, whereby relative movement between the hoop mount and the backboard mount is minimized and structural load transfer therebetween is enhanced during use of the basketball hoop structure.

8. Basketball hoop mounting structure according to claim 1 wherein the basketball hoop is welded to the hoop mount horizontal leg, and a pair of support rods are welded at their opposite extremities to the hoop mount vertical leg and the hoop, respectively.

9. Basketball hoop mounting structure according to claim 1 wherein the track channels are upwardly open whereby the hoop mount is upwardly slidably separable from the backboard mount.

10. Basketball hoop mounting structure comprising:

a backboard mount including a back member having a vertical fastener slot, a pair of oppositely located, vertically oriented front members engaging the back member in overlying relation and having track legs offset from the back member to define confronting track channels laterally spaced apart to form a vertical track opening; and a right angular hoop mount carrying a basketball hoop and including a vertical leg having side edge margins slidable within the track channels, and a horizontal leg having openings formed in its side margins which slidably receive the track legs, the hoop mount further including fastener means carried by the hoop mount vertical leg, slidably disposed through the fastener slot, and operable to clamp the hoop mount to the backboard mount at a selected height along the track opening.

11. Basketball hoop mounting structure according to claim 10 wherein the backboard mount includes spacer means defining a fastener space providing clearance for slidable travel of the fasteer means along the fastener slot.

12. Basketball hoop mounting structure according to claim 11 wherein the fastener means comprises a headed bolt and nut, the head of the bolt being located in the fastener space, and the nut bearing against the outer face of the hoop mount vertical leg.

13. Basketball hoop mounting structure according to claim 10 wherein the depth of each side margin opening in the hoop mount horizontal leg closely approximates the thickness of the associated track leg, and wherein the thickness of the hoop mount vertical leg closely approximates the depth of the track channels, whereby relative movement between the hoop mount and the backboard mount is minimized and structural load transfer therebetween is enhanced during use of the basketball hoop structure.

14. Basketball hoop mounting structure according to claim 10 wherein the basketball hoop is welded to the hoop mount horizontal leg, and a pair of support rods are welded at their opposite extremities to the hoop mount vertical leg and the hoop, respectively.

15. Basketball hoop mounting structure according to claim 10 wherein the track channels are upwardly open whereby the hoop mount is upwardly slidably separable from the backboard mount.

* * * * *

UNITED STATES PATENT AND TRADEMARK OFFICE

CERTIFICATE OF CORRECTION

PATENT NO. : 4,815,734

DATED : March 28, 1989

INVENTOR(S) : Christopher P. Verhulst

It is certified that error appears in the above-identified patent and that said Letters Patent is hereby corrected as shown below:

Column 4, line 39, after "fastener" insert --slot,--;

line 40, after "legs" insert --which-- line 41, after "spaced" insert --apart--;

line 44, after "margins" insert --slidable--;

line 45, after "leg" insert --having--;

line 46, after "slidably" insert --receive--;

line 47, after "including" insert --fastener--;

line 49, after "slidably" insert --disposed--;

line 49, after "to" insert --clamp--; and line 51, after "selected" insert --height--.

Signed and Sealed this

Ninth Day of January, 1990

*Attest:*

JEFFREY M. SAMUELS

*Attesting Officer* *Acting Commissioner of Patents and Trademarks*